US008887915B2

(12) United States Patent
Bin

(10) Patent No.: US 8,887,915 B2
(45) Date of Patent: Nov. 18, 2014

(54) LAMP DISPLAY PACKAGING WITH FOLDING GRAPHIC LAMPSHADE DEPICTION DISPLAY PANEL

(75) Inventor: Chou Shih Bin, Taipei (TW)

(73) Assignee: Canel Lighting Co. Ltd, Guangdong (CN)

( * ) Notice: Subject to any disclaimer, the term of this patent is extended or adjusted under 35 U.S.C. 154(b) by 398 days.

(21) Appl. No.: 11/374,899

(22) Filed: Mar. 14, 2006

(65) Prior Publication Data

US 2006/0285334 A1 Dec. 21, 2006

Related U.S. Application Data

(63) Continuation-in-part of application No. 11/154,318, filed on Jun. 16, 2005, now abandoned.

(51) Int. Cl.

| | |
|---|---|
| ***B65D 5/50*** | (2006.01) |
| ***B65D 25/54*** | (2006.01) |
| ***B65D 85/42*** | (2006.01) |
| ***B65D 5/42*** | (2006.01) |

(52) U.S. Cl.

CPC ..... *B65D 5/4204* (2013.01); *B65D 5/5059* (2013.01); *B65D 5/5038* (2013.01); *B65D 5/5014* (2013.01); *B65D 85/42* (2013.01); *B65D 5/5066* (2013.01)

USPC ..... 206/418; 206/419; 206/459.5; 206/775

(58) Field of Classification Search

USPC ..... 206/418–422, 320, 326, 446, 457–458, 206/459.1, 459.5, 461–463, 471, 775–780, 206/500

See application file for complete search history.

(56) References Cited

U.S. PATENT DOCUMENTS

| | | | | | |
|---|---|---|---|---|---|
| 1,899,666 | A | * | 2/1933 | Buschman | 206/419 |
| 2,325,224 | A | * | 7/1943 | Bryant | 206/446 |
| 3,252,566 | A | * | 5/1966 | Hanson | 206/783 |
| 3,349,897 | A | * | 10/1967 | Stone | 206/780 |
| 3,627,115 | A | * | 12/1971 | Samalon | 206/497 |
| 3,631,970 | A | * | 1/1972 | Trauschke | 206/779 |
| 4,099,612 | A | * | 7/1978 | Hanson | 206/783 |
| 4,146,128 | A | * | 3/1979 | Hogg et al. | 206/776 |
| 4,189,051 | A | * | 2/1980 | Fales et al. | 206/326 |
| 4,191,289 | A | * | 3/1980 | Austin | 206/780 |
| 4,257,211 | A | * | 3/1981 | Fales et al. | 53/442 |
| 4,773,539 | A | * | 9/1988 | Nock | 206/418 |
| 5,582,293 | A | * | 12/1996 | Kay | 206/457 |
| 5,692,611 | A | * | 12/1997 | Harrison | 206/418 |
| 5,813,523 | A | * | 9/1998 | Gnadt et al. | 206/776 |
| 6,325,209 | B1 | * | 12/2001 | Humphrey | 206/320 |
| 6,419,085 | B1 | * | 7/2002 | Humphrey | 206/320 |
| RE39,565 | E | * | 4/2007 | Humphrey | 206/320 |
| 2002/0125163 | A1 | * | 9/2002 | Chou | 206/418 |
| 2004/0149625 | A1 | * | 8/2004 | Sherman et al. | 206/775 |

* cited by examiner

*Primary Examiner* — Bryon Gehman

(74) *Attorney, Agent, or Firm* — Lieberman & Brandsdorfer, LLC

(57) ABSTRACT

Embodiments include a lamp and collapsing lampshade packaging, shipping and display device. The device includes a shell, with a hood, central trunk and bottom receptacle, and which further includes a graphic depiction of the collapsible lampshade on a display panel which may be deployed when the device is used for display purposes, thus making it appear that the collapsible lampshade is assembled and mounted on the displayed lamp. The panel may be permanently affixed in a fold-out manner to the top of the device or alternatively it may be separable from it. In the case of a permanent panel, a releasable holding secures the panel close to the shell during storage or transit. For a separable panel, releasable fixing allows panel deployment on the face of the hood for viewing. The device may store more than one lamp and the panel may include renderings of more than one lampshade.

23 Claims, 11 Drawing Sheets

LAMP DISPLAY PACKAGING WITH FOLDING GRAPHIC LAMPSHADE DEPICTION DISPLAY PANEL

RELATED APPLICATIONS

This application is a continuation-in-part of U.S. application Ser. No. 11/154,318 filed Jun. 16, 2005, now abandoned.

FIELD OF THE INVENTION

The present invention relates to the field of packaging for electric lamps. More specifically, the present invention is a packing, shipping, storage and display packaging device with a foldout graphic lampshade display panel for lamps with collapsible shades.

BACKGROUND OF THE INVENTION

Many types of packaging cartons are available in the marketplace which are prepared from blanks made from cardboard, plastic or other suitably flexi-stiff materials. Flexi-stiff materials are generally flexible enough for bending into place during assembly but stiff enough to retain their shape afterwards. The blanks are pre-dimensioned, pre-creased and pre-cut into sections such that when the so-defined areas are separated, folded and inter-connected, the assembled product is suitable for use in the packaging, shipping, storage and/or display of an article for which it is designed to contain.

Many versions of packaging cartons have been designed for use with lamps and lampshades. Some of these provide containment for the lamps with a separate containment for the shades. Others provide for joint packaging of the lamp and shade For example, Humphrey in U.S. Pat. Nos. 6,325,209 and 6,419,085 teaches the use of packaging designed to store and protect the lamp during shipment and display. One embodiment displays only the lamp, and another displays the lamp and part of the shade.

In the above referenced spending application Ser. No. 11/154,318, a packaging device is disclosed wherein a combination view of the lamp with the shade is provided for displaying the lamp and shade together where display space for the shade is limited. In this inventive concept, a collapsible lampshade is stored behind a trunk insert panel, which via a viewing hole through the panel, allows a viewer of the packaging device to see the color and texture of the lampshade.

While the above invention provides a greater measure of utility than its predecessors, it is still lacking. While a viewer may be able to see a portion of the lampshade through the viewing hole, he does not get a sense of the look of the lamp with the shade assembled and mounted. Thus there is a need for a better way to represent the lamp and lampshade combination without taking all of the space required to actually mount the lamp.

SUMMARY OF THE INVENTION

A lamp packaging device is disclosed which provides a useful shipping and storage container as well as a convenient display box for lamps with collapsible-shades. A central feature of the packaging device of the present invention is a deployable in upon which is depicted a graphic two-dimensional image of the matching lampshade in its assembled configuration. The panel is deployed near the top of the front of the packaging device, whenever the device is used for displaying (as opposed to packaging, e.g., for shipment or storage) a lamp and shade combination for viewers to see.

With the panel deployed in this position, the graphic lampshade image projects upward from approximately the top of the lamp, which is stored behind and just below the panel, effectively creating the appearance, at least from a frontal perspective, of the lampshade being mounted on the lamp. This permits a seller of such lamps to display a representative view of the lamp and shade, without having to actually use the space required of a full lampshade assembly and mounting on the lamp.

In a first embodiment, the device comes with a panel which is permanently attached at one edge to the top front edge of the hood of the display box, and which folds down across the top of the box, possibly extending down over the back of the box, where the opposite edge of the panel it is releasably connected to the device for stowing during transport or warehousing. The graphic image may comprise the entire two-dimensional profile of the lampshade, or it may comprise a truncated version, if the actual shade width is too wide to fit on the width of the panel.

In another embodiment, the panel may fold down over the front of the hood, where it is attached for shipping and storage. This embodiment may comprise an optional additional graphic on the back side of the panel which, when the panel is folded down, may display a written description of the contents of the box and/or a picture of the lamp with the shade mounted in place. In this case, the panel may remain folded down during display, if desired.

In another embodiment, the panel may comprise additional side sections, which deploy in a plane with the main panel section when the package is used for display and which stow against the sides of the top of the device when the device is prepared for shipment or non-display storage.

In another embodiment, a separate panel may be shipped with or separate from the display device. This panel may be planar, in one or more parts, or it may be folded for storage when not being used to display the lampshade. In this embodiment, a releasable fastener provides the means to temporarily affix the panel to the front of the top of the packaging device during display periods.

In another embodiment, a pair or more of lamps may be packaged side-by-side with their corresponding lampshades packaged within the central trunk storage area of the device. In this case, the lampshade display panel may display one, two or more depictions of lampshades, nested so as to create the appearance of the lamps being staggered, so that some of the lampshades appear to be partially hidden behind others. Again, this panel may be sized to fit the width of the display box, possibly truncating the lampshade images at the edges of the panel, or it may be configured to be wider so as to provide a more accurate look.

BRIEF DESCRIPTION OF THE DRAWINGS

Exemplary embodiments of the invention are discussed hereinafter in reference to the drawings, in which.

DETAILED DESCRIPTION OF PREFERRED EXEMPLARY EMBODIMENTS

Figure 1:
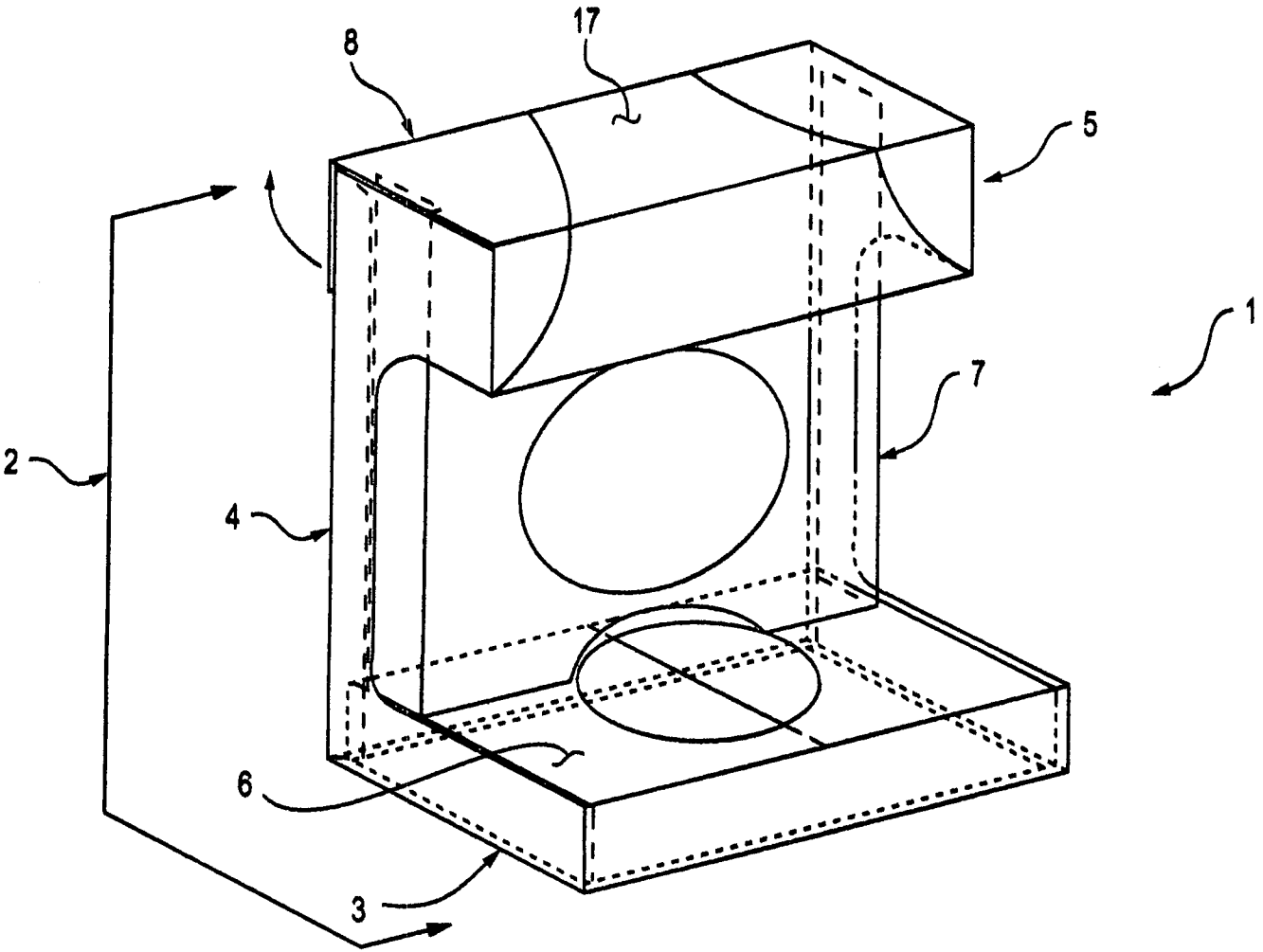
FIG. 1 is a view of the packaging device with a fold-out deployable panel depicting a graphical representation of a lampshade on its front face. In this view, the panel is shown folded over and behind the hood where it is held in place against the shell by a releasable fixing means.
Figure 2:
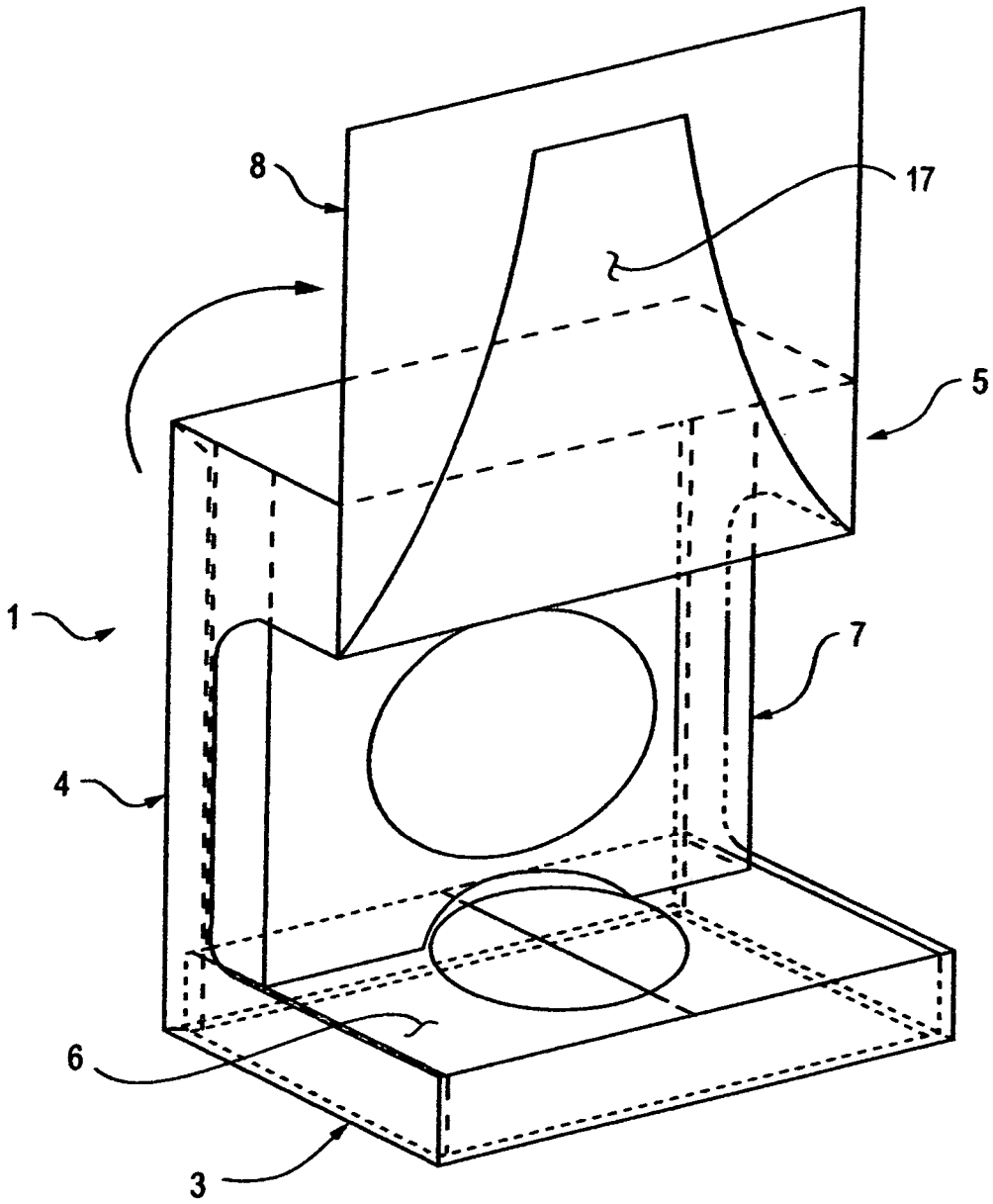
FIG. 2 is a view of the packaging device of FIG. 1 with the deployable fold-out panel unfolded and deployed in a straight vertical arrangement, thus allowing a viewer to see a two-dimensional graphical depiction of a lampshade.

In a preferred embodiment, as shown in FIGS. 1 and 2, the lamp and lampshade packaging device 1 of the present invention comprises a shell 2 having features including a bottom receptacle 3, a central trunk 4 and a top hood 5. The device further comprises a support base 6 and a trunk insert 7.

Each of elements 3 through 7 comprise cardboard, or any other lightweight, reasonably stiff material which will conform to and retain a formed shape, without collapsing, when the material is scored, perforated or otherwise locally weakened for the purposes of folding the material into such shape. The art of scoring cardboard for folding into a packaging shape is well known in the field, and it may be applied to the extent necessary to produce the device herein taught without prejudice thereto. For example, co-pending application Ser. No. 11/154,318 demonstrates one approach to forming cardboard for the purposes of creating a packaging device for lamps and lampshades.

Figure 3:
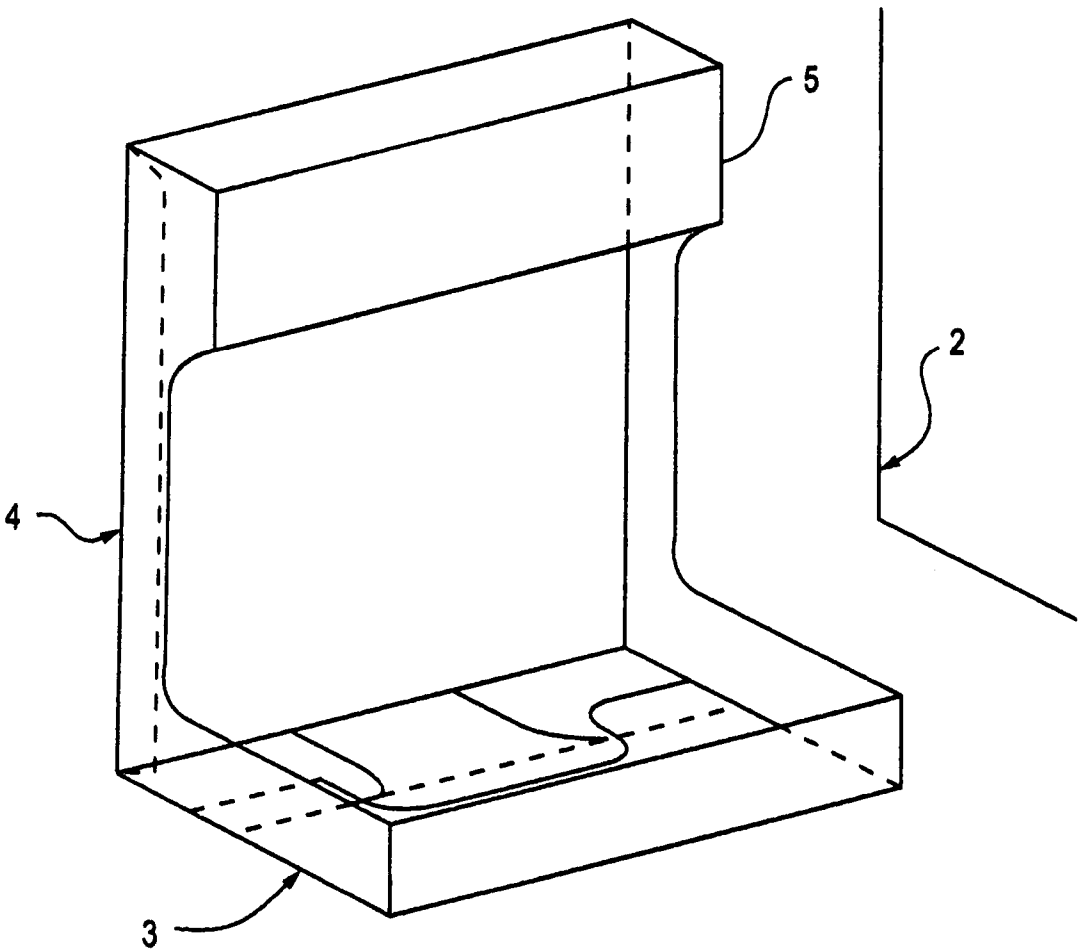
FIG. 3 is a view of the shell 2 of the packaging device of FIG. 1 having a bottom receptacle 3, central trunk 4 and top hood 5.

Shell 2 is depicted independent of support base 6 and insert 7 in FIG. 3. The shell may be fabricated by folding and interconnecting sides and edges from a single piece of material, or it may be made of multiple pieces as desired without departing from this inventive teaching.

Figure 4:
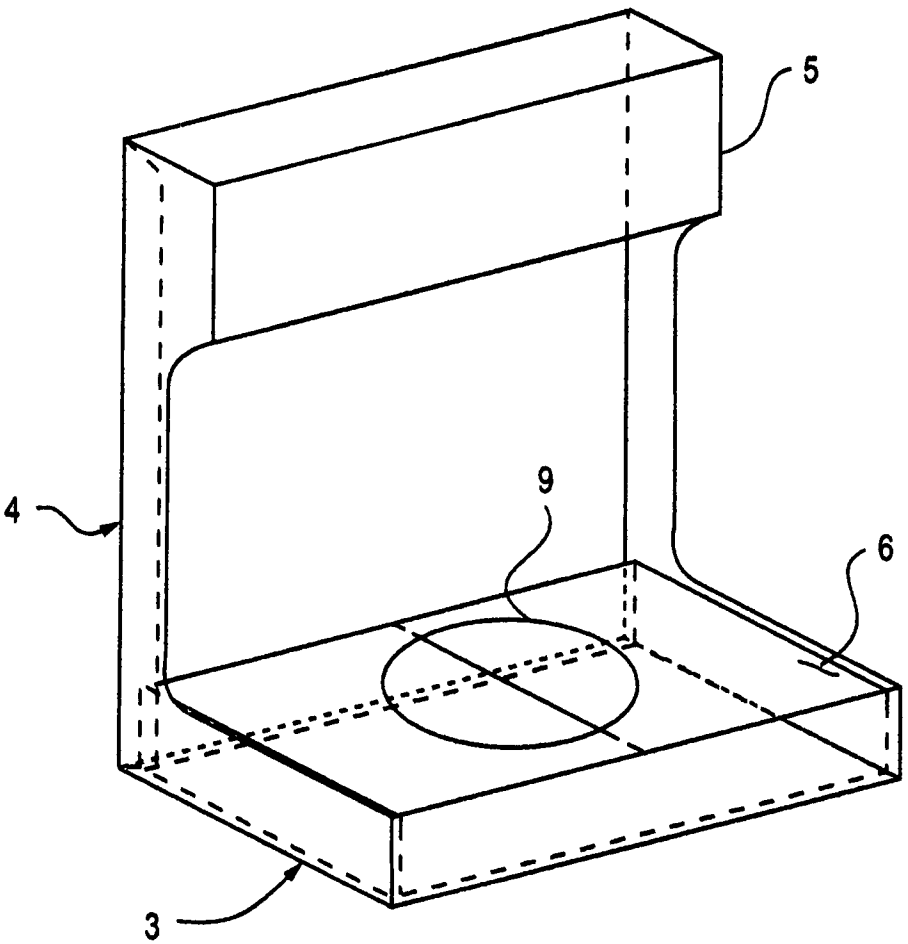
FIG. 4 is a view of the shell of FIG. 3 with support base 6 installed within bottom receptacle 3. Recess 9 is visible on the top side of the support base. A collapsible lampshade would be collapsed and placed into the cavity of the central trunk at this point, if desired for storage.

Bottom receptacle 3 is sized to accommodate support base 6 as is shown in FIG. 4. Base 6, in turn, may be configured as required to accommodate and support for packaging and display the base of any style of lamp. Base 6 also serves as a base of support for insert 7 as will be shown hereunder. Base 6 may be constructed from either a single sheet or multiple sheets of material as described for shell 2 above. A key feature of the base is that it include a recessed area 9 for engaging the base of a lamp to be stored in the packaging device 1. The recessed area serves to prevent the base of the stored lamp from sliding off the base unless it is raised upward by someone wishing to remove it from the confines of the packaging.

Figure 5A:
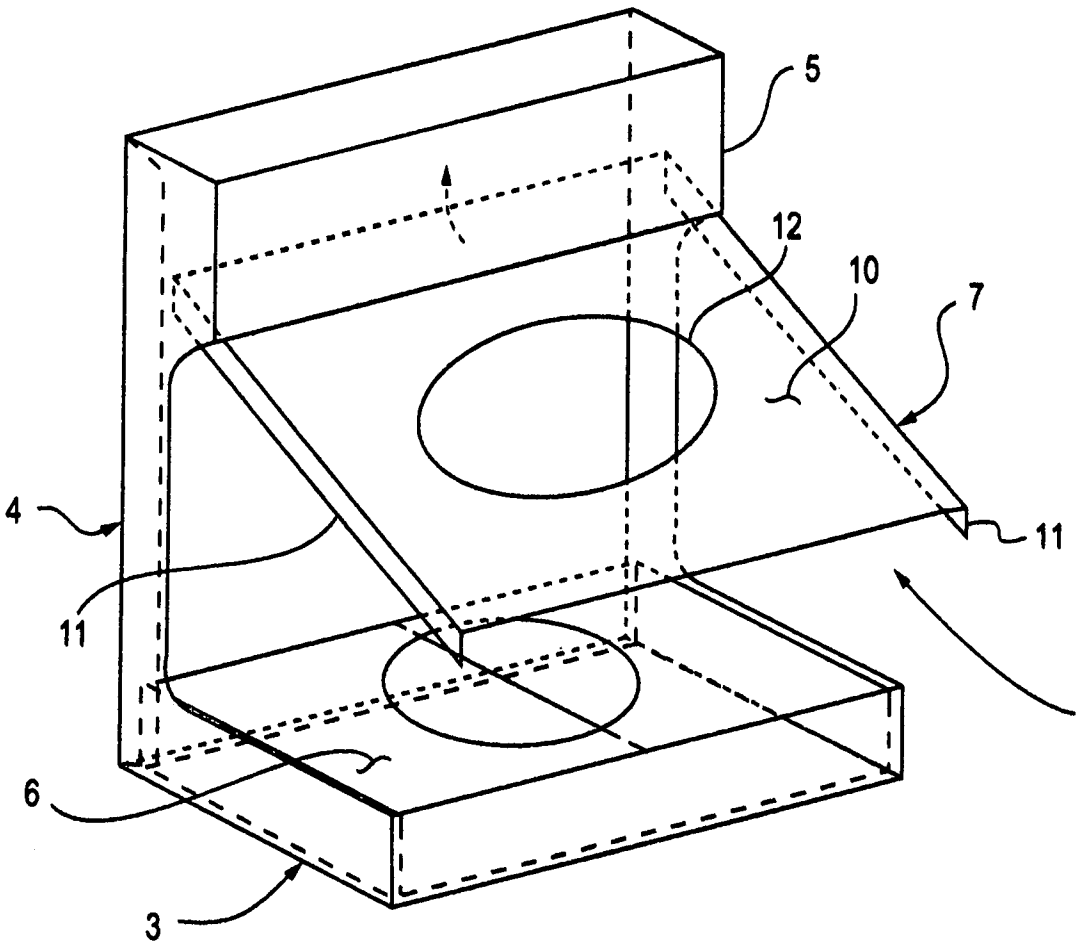
FIG. 5A is a view of the shell of FIG. 4 with trunk insert 7 being installed into central trunk 4. In this view, the top of the insert is being fit into the bottom of top hood 5.
Figure 5B:
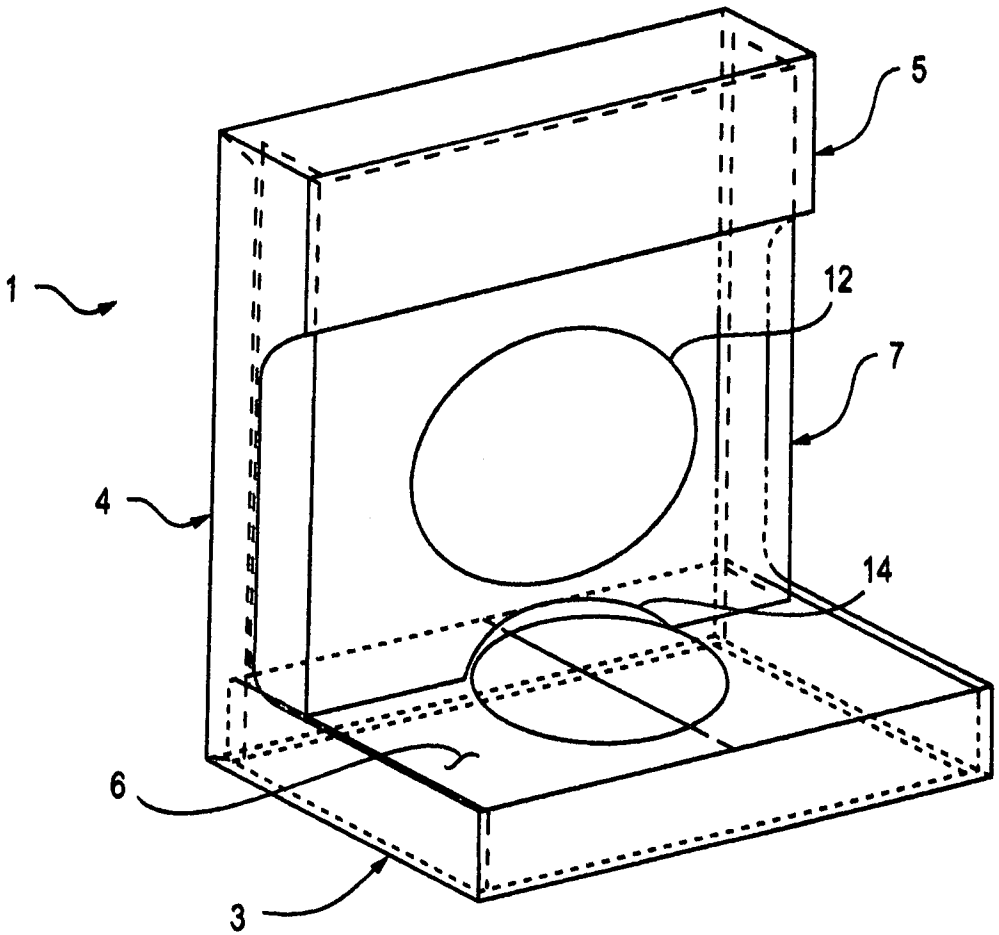
FIG. 5B is a view of the shell of FIG. 5A with trunk insert 7 installed within the central trunk 4 and lowered to rest on support base 6. A collapsable lampshade would be covered by the trunk insert and thus, enclosed within the central trunk at this point if such a lampshade had been collapsed and placed into the cavity of the central trunk before the trunk insert was installed.
Figure 6:
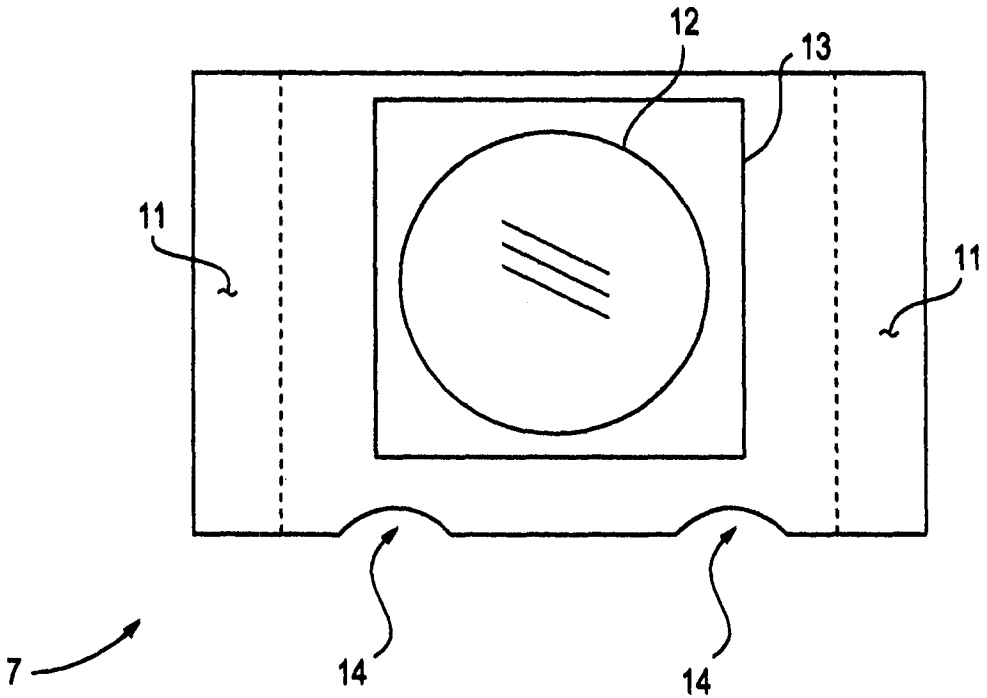
FIG. 6 is a detail view of the trunk insert. It shows side panels 11 and the optional viewing hole 12 and clear protective film 13.

Central trunk 4 comprises an open cavity bordered on three sides by the mid-sectional sides and back of shell 2. The purpose of the cavity is to accept a collapsible lampshade which is to be packaged with a corresponding lamp. Insert 7 comprises a front face 10 with side panels 11 as shown in FIG. 5A. When a collapsible lampshade is collapsed and placed inside the cavity (see FIG. 7), one end of insert 7 is inserted into the cavity as shown in FIG. 5A. The insert is adjusted down over the cavity so as to seal the cavity as shown in FIG. 5B. When the insert is in place, it will rest on base 6. As shown in FIG. 6 the insert may optionally comprise a viewing hole 12 which is optionally covered with a clear film 13. The purpose of the viewing hole is to enable a party viewing the device to be able to see the color and texture of a lampshade stored within the central trunk when that lampshade is otherwise covered by the insert during packaging. The purpose of the transparent film is to protect the lampshade from dust, finger oils and other contaminants during display. The central trunk will be sized (height, width and depth) to accommodate any sized lampshade and the insert may be configured with a notch 14, as shown in FIG. 5B, if necessary to avoid interference with and to help hold in place within recess 9 on support base 6 the bottom of a amp placed within the device for packaging and/or display.

Figure 7:
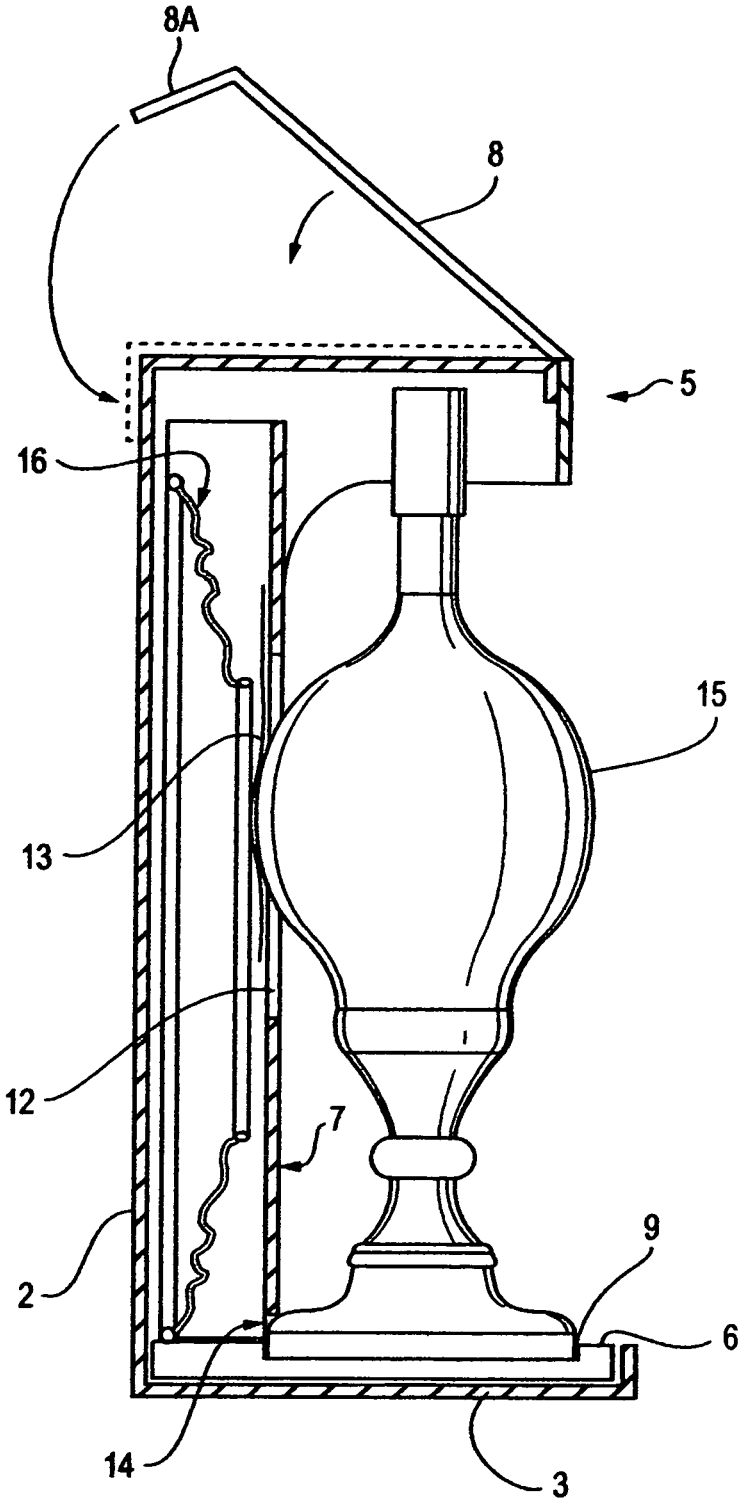
FIG. 7 is a side cut-away view of the packaging device of FIG. 1 with collapsible lampshade 16 stored behind trunk insert 7 and with lampshade 15 stored within the device for packaging, shipping or display. Display panel 8 is shown partially deployed and being stowed for shipping or storage.

In the illustrated embodiment, shown in FIG. 7, top hood 5 comprises an enclosure for housing the top of a lamp 15 when the lamp is placed into the device for packaging. The bottom of the hood contains an opening sized to accept the top of the lamp when the lamp is placed on base 6 in front of insert 7. FIG. 7 also depicts the preferred embodiment with a collapsed lampshade 16 stored within central trunk 4 behind insert 7.

The hood 5 further comprises a folding panel 8 which is connected to the top edge of the front side of the hood, and which may be folded to lay across the top of the hood and to further fold down along the back side of the hood when stowed. A graphic rendering 17 of lampshade 16 is associated with the front side of panel 8 such that when the panel is deployed into the upright position as shown in FIG. 2, it will appear to a viewer standing in front of a lamp 15 stored within packaging device 1 that a lampshade is fitted on top of the lamp. That is, the graphic depiction 17 of lampshade 16 on the upright standing panel 8 will tend to create the illusion of the lampshade having been placed upon the lamp. The panel is shown in the stowed position in FIG. 1 and in the open position in FIG. 2. It is shown in the partially deployed position in FIG. 7. In that figure, panel 8 is shown comprising a section 8A which will, when the panel is stowed, come to rest against the back side of hood 5. This section is optional; its incorporation into the design will generally be determined by the height of the lampshade to be graphically depicted on the panel. A shorter lampshade will not require a section 8A. In either case, with or without the incorporation of a section 8A, panel 8 must be stowed in a releasably secure manner during transport and storage. Therefore, it is envisioned that some form of releasable securing mechanism be employed between the panel and the hood at least at one point where the panel rests against the hood. A loop and hook set of pads may be employed wherein one pad is affixed to the backside of the panel and the opposing pad is affixed to the top or back side of the hood such that when the panel is stowed against the hood, the pads engage, thereby securing the panel in place. Alternate means of releasable securing may be employed, such as semi-bonding adhesive strips or other means.

Figure 10:
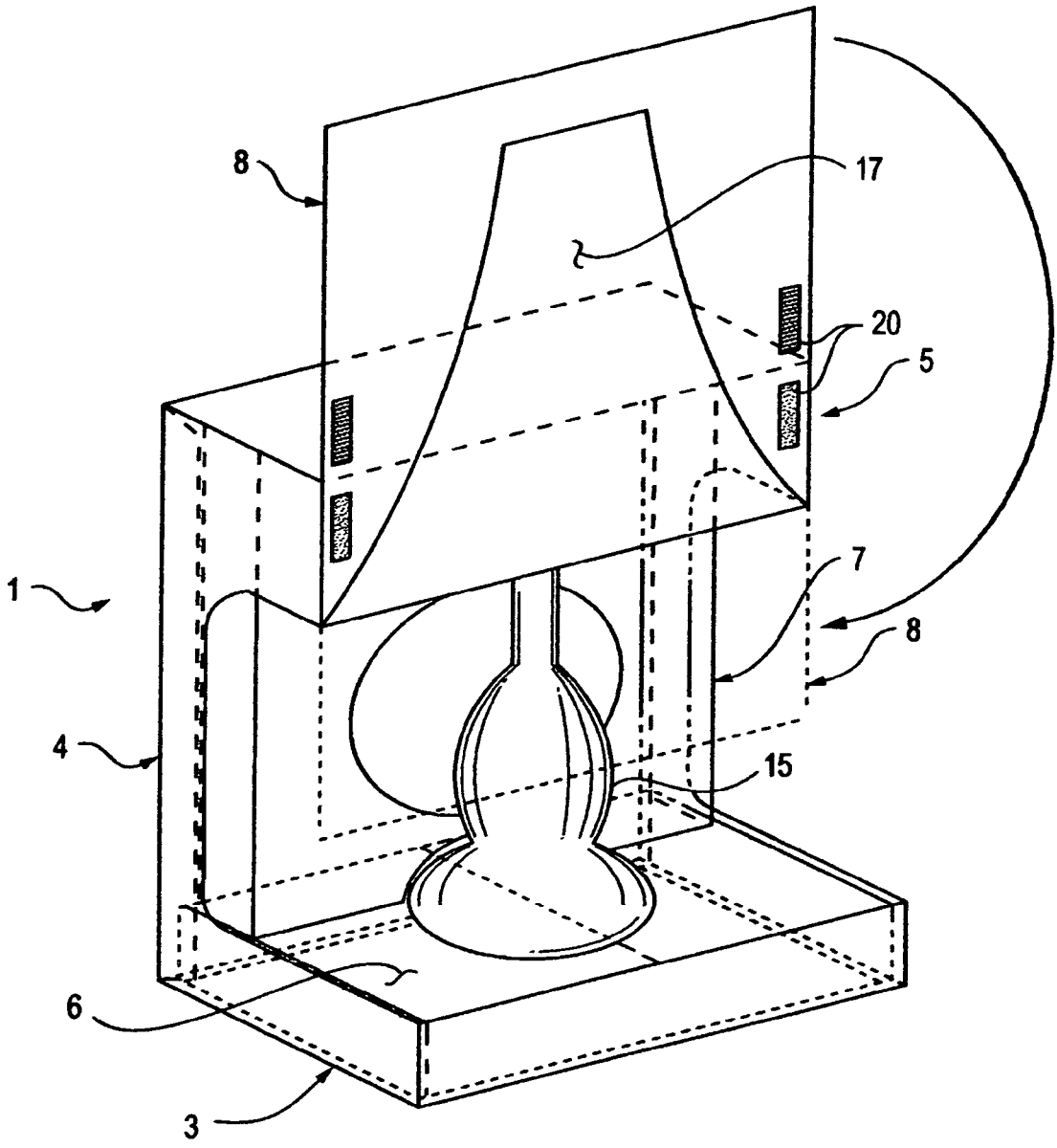
FIG. 10 is a view of the device of FIG. 2 wherein the fold-out panel may be folded forward rather than backward over the hood.

In an alternate embodiment, as shown in FIG. 10, panel 8 may also be folded over the front of the hood during shipment and storage. In this embodiment, the securing means 20 may be attached to the front of both the panel and the hood such that the means will engage when the panel is folded forward. Since the rear portion of the panel will now be visible when the panel is folded forward, the rear portion may be adorned with marketing advertisements, such as a list of the contents of the device and/or a second graphic depicting a view of the lamp with its shade mounted for use.

In an alternate embodiment, panel 8 may also incorporate side sections, which would be capable of depicting extra large width lampshades. In this case, the side sections would stow against the sides rather than the back side of the hood. Alternatively, in place of, or in addition to panel 8 and side sections, a separate panel may be shipped with the packaging device which may be removed from the device and affixed to the front of the hood for the purposes of creating the illusion of deployed lampshades. The separate panel may be made from a single or multiple pieces of material and it may be folded or unfolded as the size of the lampshade dictates.

Figure 8:
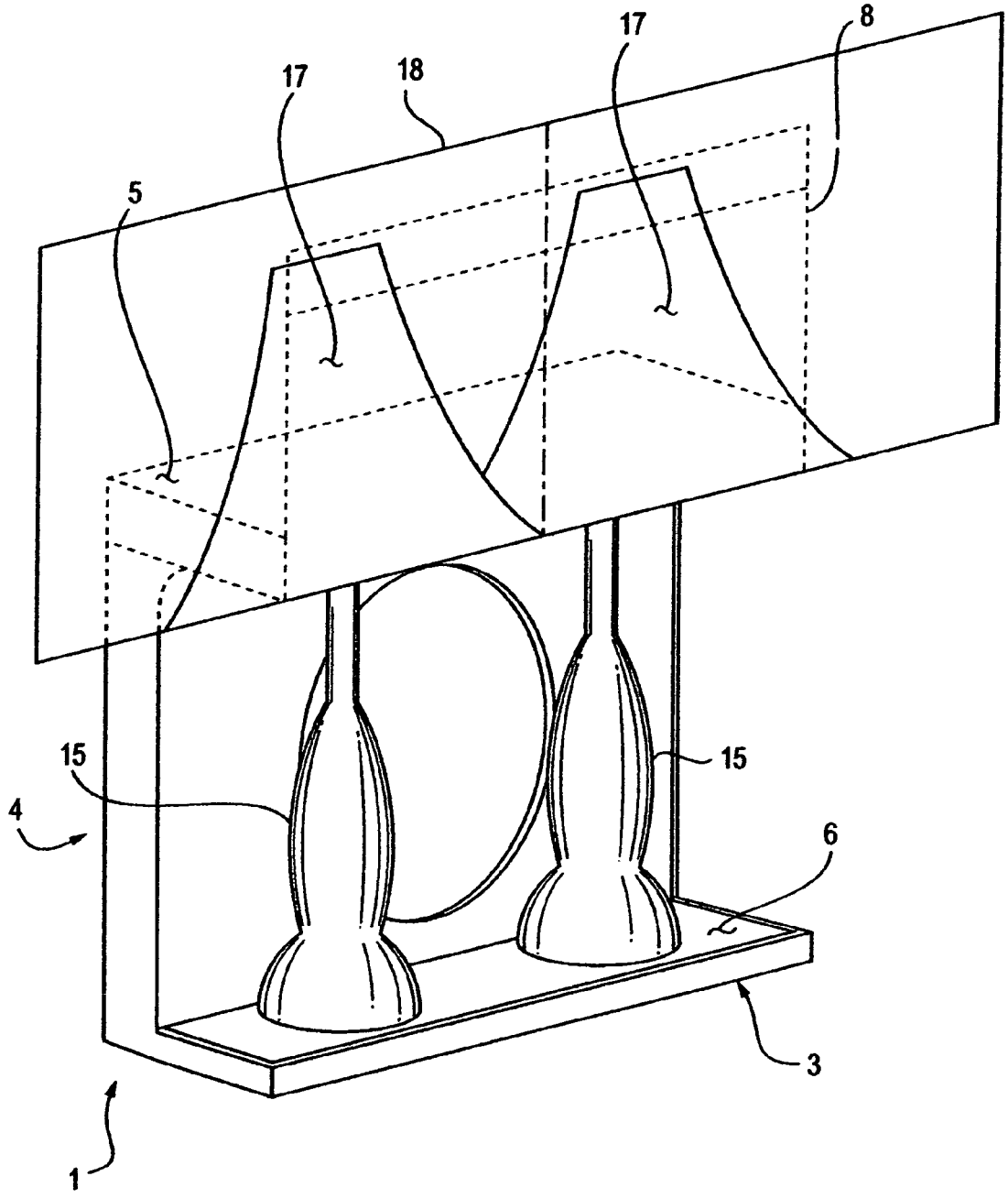
FIG. 8 is a view of an embodiment of the packaging device with multiple lamps stored therein. In this view two lamps are stowed within the device and the graphic display panel is depicted as a separable unit which is releasibly mounted on the front of the device.

In another embodiment, it is possible to create a packaging device for a pair or more of lamps and lampshades. In this case, two or more lamps would be stored together, side-by-side. The graphic depiction 17 of the lampshades on any of the above panel embodiments would then have to take into consideration the proximity of the lampshades to each other, potentially necessitating the depiction of the lampshades "overlapping"; i.e, one slightly behind the other. An embodiment of packaging device 1 storing a pair of lamps 15 and having a folded panel 18 affixed to the front of both hood 5 and, in this embodiment, panel 8 is shown in FIG. 8. In this embodiment, panel 18 includes graphical rendering 17 of a pair of lampshades, positioned above and centered over the vertical axes of stored lamps 15 to create the illusion of the shades being mounted on the lamps. The graphical depiction 17 depicts the shades a partially overlapping. Panel 8 is utilized in this case to help provide stability to the deployment of panel 18 to which it is attached via a releasable fastening means as described above.

Figure 9:
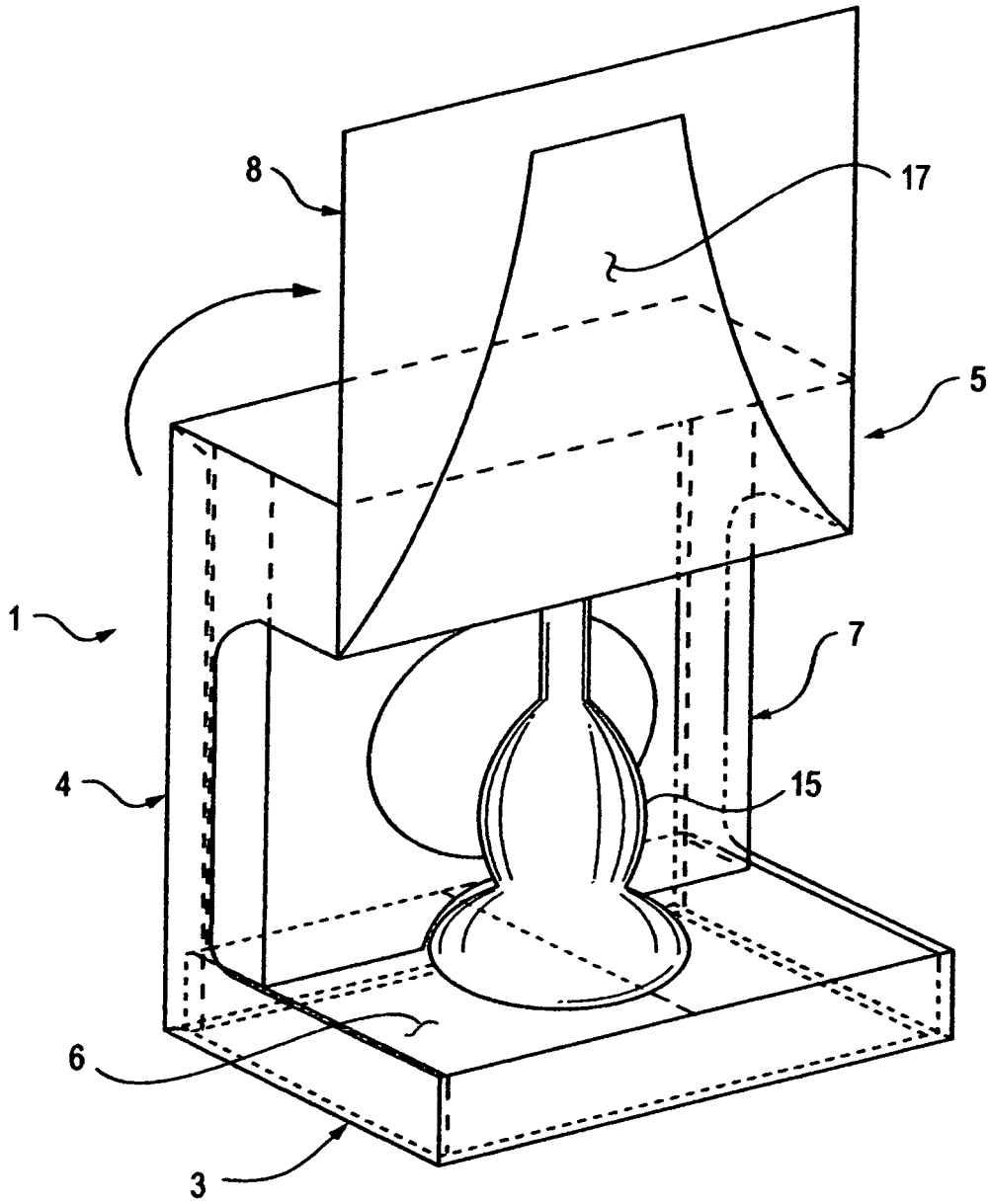
FIG. 9 is a view of the device of FIG. 2 with a lamp stored and the fold-out panel deployed for display.

To utilize the device for packaging for shipment or storage, the device is first folded to create the separate shell, support base and trunk insert. The lampshade(s) are collapsed and stored within the central trunk. The support base is inserted into the bottom receptacle and the top of the trunk insert is slid up into the hood and its side panels are tucked into the central trunk, thus enclosing the lampshades behind it. The insert is slid down to rest on the support base. Next, the top(s) of the lamp(s) are slid up into an opening in the underside of the hood and down into the recess(es) in the support base. This secures the lamp for shipment The graphic display panel is either folded down over the top, as would be appropriate for the first embodiment, or it is stowed within the central trunk or elsewhere as would be appropriate for the separate panel embodiment. When the lamp arrives at the display site, the display panel is released and oriented upright extending upward from the hood in a manner that creates an impression of mounted lampshade(s) to a viewer viewing the display from the front. This configuration is depicted in FIG. 9 for a single lamp 15 displayed with an attached, fold-out graphic display panel 8.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed is:

1. A packaging device comprising:

a shell for receiving at least one lamp and at least one lampshade, the packaging having a bottom receptacle, a central trunk, and a top hood;

a support base removably positioned within the bottom receptacle; and a trunk insert removably positioned within an open cavity of the central trunk, wherein;

the hood includes a releasably secured folding panel the folding panel comprises a display panel extending, in a folded configuration, from the top edge of a front side of the hood and across a top side of the hood where it is releasably connected to the shell, and the display panel further comprising a graphic depiction associated with a front side of the display panel, the folding panel and graphic depiction to provide a simulation of the at least one lampshade mounted on a received at least one lamp.

2. The device of claim 1, wherein said shell, support base, trunk insert and hood comprises a lightweight, reasonably stiff material which will conform to and retain a formed shape, without collapsing, when the material one of is scored, perforated or otherwise locally weakened for the purpose of folding the material into the shape.

3. The device of claim 1, wherein the hood comprises a separate display panel which may be mounted on the hood, and supported by the releasably secured folding panel and further comprising a graphic depiction of the mounted lampshade associated with a front side of the separate display panel.

4. The device of claim 1, wherein the at least one lampshade is received within an enclosure created by positioning the trunk insert within the central trunk.

5. The device of claim 4, wherein the trunk insert further comprises an opening from which a viewer of the device can peer inside the enclosure to view color and texture of the received at least one lampshade.

6. The device of claim 5, further comprising a transparent film to cover the opening, the film to protect the received at least one lampshade.

7. The device of claim 1, further comprising the hood having a bottom opening the bottom opening configured to receive a top of the received at least one lamp for packaging and display.

8. The device of claim 1, further comprising recessed area within the support base, the recessed area to engage a bottom of the received at least one lamp in a non-slip manner.

9. The device of claim 1, further comprising marketing information associated with a back side of the display panel to be viewed when the panel is folded down over the front of the hood.

10. A method of displaying a lamp and a lampshade comprising:

placing at least one lamp and at least one lampshade in a packaging device, wherein the device comprises:

a shell for receiving the lamp and lampshade and the shell having a bottom receptacle, a central trunk and a hood;

a support base removably positioned within the bottom receptacle; and a trunk insert removably positioned within an open cavity central trunk, wherein;

the hood includes a releasably secured folding panel, the folding panel comprises a display panel extending, in its folded configuration, from a top edge of a front side of the hood and across a top side of the hood where it is releasably held against the shell, and the display panel further comprising a graphic depiction associated with a front side of the display panel, the folding panel and graphic depiction to provide a simulation of the at least one lampshade mounted on a received at least one lamp.

11. The method of claim 10, wherein the deploying comprises orienting the releasably secured folding panel in a vertical position associated with a front side of the hood with the display panel facing a viewer of the at least one lamp displayed within said device.

12. The method of claim 10, wherein the shell, support base, trunk insert and releasably secured folding panel comprises lightweight, reasonably stiff material which will conform to and retain a formed shape, without collapsing, when the material is one of scored, perforated or otherwise locally weakened for the purpose of folding the material into the shape.

13. The method of claim 10, wherein the releasably secured folding panel comprises a separate display panel which may be mounted on the hood and further comprising a graphic depiction of the mounted lampshade associated with a front side of the separate display panel.

14. The method of claim 10, further comprising placing the at least one lampshade within an enclosure created by positioning the trunk insert within the central trunk.

15. The method of claim 14, wherein the trunk insert further comprises an opening for viewing the enclosure, including viewing color and texture of the at least one lampshade.

16. The method of claim 15, further comprising covering the opening with a transparent film to protect the at least one lampshade.

17. The method of claim 10, further comprising inserting a top of the at least one lamp into a bottom opening of the hood for packaging and display.

18. The method of claim 10, further comprising forming a recessed area within the support base for engaging the bottom of the at least one lamp in a non-slip manner.

19. The method of claim 10, further comprising marketing information associated with a back side of the display panel to be viewed when the panel is folded down over the front of the hood.

20. A packaging device comprising:

a shell for receiving at least one lamp and at least one lampshade, the packaging having a bottom receptacle, a central trunk, and a top hood;

a support base removably positioned within the bottom receptacle; and a trunk insert removably positioned within an open cavity of the central trunk, wherein;

the hood includes a releasably secured folding panel, and, wherein;

the hood comprises a separate display panel which may be mounted on the hood, and supported by the releasably secured folding panel and the display panel further comprising a graphic depiction of the at least one lampshade associated with a front side of the separate display panel to simulate mounting on the received at least one lamp.

21. A method of displaying a lamp and a lampshade comprising:

placing at least one lamp and at least one lampshade in a packaging device, wherein the device comprises:

a shell for receiving the lamp and lampshade and the shell having a bottom receptacle, a central trunk and a hood;

a support base removably positioned within the bottom receptacle; and a trunk insert removably positioned within an open cavity central trunk, wherein;

the hood includes a releasably secured folding panel, and deploying the releasably secured folding panel, thereby providing observation of the device with a representative view of the at least one lamp assembled within the packaging device, wherein;

the releasably secured folding panel comprises a separate display panel which may be mounted on the hood and further comprising a graphic depiction associated with a front side of the separate display panel the graphic depiction to simulate of the at least one lampshade mounted on the at least one lamp.

22. A packaging device comprising:

a shell for receiving at least one lamp and at least one lampshade, the packaging having a bottom receptacle, a central trunk, and a top hood;

a support base removably positioned within the bottom receptacle; and a trunk insert removably positioned within the open cavity of the central trunk, wherein;

the hood includes a releasably secured folding panel;

the releasably secured folding comprises a folding display panel to simulate the at least one lampshade mounted on the received at least one lamp, extending, in its folded configuration, from a top edge of a front side of the hood across the front side of the hood, where it is releasably secured to the hood, and further comprising a graphic depiction of the mounted lampshade associated with a front side of the display panel and further comprising marketing information associated with a back side of the display panel to be viewed when the panel is folded down over the front of the hood.

23. A method of displaying a lamp and a lampshade comprising:

placing at least one lamp and at least one lampshade in a packaging device, wherein the packaging device comprises:

a shell for receiving the lamp and lampshade and the shell having a bottom receptacle, a central trunk and a hood;

a support base removably positioned within the bottom receptacle; and a trunk insert removably positioned within an open cavity central trunk, wherein;

the hood includes a releasably secured folding panel, and deploying the releasably secured folding panel, thereby providing observation of the device with a representative view of the at least one lamp assembled within the packaging device, wherein;

the releasably secured folding panel comprises a folding display panel extending, in its folded configuration, from the top edge of a front side of the hood across the front side of the hood where it is releasably secured to the hood, and further comprising a graphic depiction of the lampshade associated with a front side of the display panel, the graphic depiction to simulate mounting of the at least one lampshade with the at least one lamp and further comprising marketing information associated with a back side of the display panel to be viewed when the panel is folded down over the front of the hood.

* * * * *

UNITED STATES PATENT AND TRADEMARK OFFICE

CERTIFICATE OF CORRECTION

PATENT NO. : 8,887,915 B2
APPLICATION NO. : 11/374899
DATED : November 18, 2014
INVENTOR(S) : Chou Shih Bin It is certified that error appears in the above-identified patent and that said Letters Patent is hereby corrected as shown below:

In the Claims:

Column 8, Claim 22, lines 25-26, cancel "to simulate the at least one lampshademounted on the received at least one lamp,".

Column 8, Claim 22, lines 30-31, cancel "of the mounted lampshade".

Column 8, Claim 22, line 32, "the display panel" should be changed to --the display panel to simulate the at least one lampshade on the received at least one lamp,--.

Signed and Sealed this
Twenty-first Day of April, 2015

Michelle K. Lee

Michelle K. Lee
*Director of the United States Patent and Trademark Office*